United States Patent [19]

Reinhardt et al.

[11] Patent Number: 5,030,136

[45] Date of Patent: Jul. 9, 1991

[54] CONNECTOR FOR CABLES

[75] Inventors: Joerg Reinhardt; Guenther Schmitz; Udo Seidel, all of Hamburg, Fed. Rep. of Germany

[73] Assignee: Minnesota Mining and Manufacturing Company, St. Paul, Minn.

[21] Appl. No.: 491,118

[22] Filed: Mar. 9, 1990

[30] Foreign Application Priority Data

Apr. 14, 1989 [DE] Fed. Rep. of Germany ..... 3912273

[51] Int. Cl.[5] ..... H01R 13/58; H01R 4/24

[52] U.S. Cl. ..... 439/460; 439/392; 439/719

[58] Field of Search ..... 439/449, 460, 719, 349, 439/400, 407, 441, 440, 438, 452, 457, 392, 396

[56] References Cited

U.S. PATENT DOCUMENTS 4,169,645 10/1979 Faulconer ..... 439/392

4,722,699 2/1988 Heng et al. ..... 439/396

*Primary Examiner*—Larry I. Schwartz

*Assistant Examiner*—Julie R. Daulton

*Attorney, Agent, or Firm*—Gary L. Griswold; Walter N. Kirn; John C. Barnes

[57] ABSTRACT

Flexible retaining tongues are formed within a cable receiving passageway of a basic body, the tongues retaining the cable therebetween, and being resiliently deformed upon insertion of the cable whereby an effective strain relief is achieved concurrently.

10 Claims, 1 Drawing Sheet

CONNECTOR FOR CABLES

The invention is related to a connector for insulated conductors such as cables, particularly for electrical telecommunication cables.

DESCRIPTION OF THE PRIOR ART

Connectors of the kind mentioned typically include insulation-penetrating cutting terminals within at least one passageway. Further, suitable retaining means are provided retaining the cable in position and restrict removal of the cable from the passageway if the normally attached cover is removed. In case the cable is urged out of the passageway, the danger is encountered that electrical contact will be interrupted. Particularly for telecommunication cables it is undesired that the transfer of data is interrupted if work is undertaken at the connectors.

The German patent specification 36 22 164 discloses retaining means for connection wires in a connector wherein the side walls of an entrance slot include flexible barbs such that cables of different diameters can be introduced and secured against an outward movement. With respect to the retaining purposes, this problem is satisfactorily solved by the known retaining means. However, the known retaining means do not enable a strain relief which normally is additionally required. Strain relief means that a tension force at the cable is not immediately transmitted to the contact area, rather, a structural feature is necessary to maintain the electrical contact by forming a sufficient resistance against the cable being pulled out of the connector.

U.S. Pat. No. 4,262,985 discloses a connector for connecting wires wherein retaining means and means for a strain relief are integrally formed with a housing of plastic material. The retaining means is defined by a slot with an entrance portion thereof having a smaller width than below the entrance portion so that movement of the cable out of the slot is restricted. The strain relief means are defined by tongues extending at an angle with respect to the longitudinal axis of the cable, the tongues being resiliently deformed if the cable is inserted. It is a disadvantage with the known connector that the overall dimensions of the connector are relatively large due to separate means for the retaining and the strain relief purposes, respectively. It is further disadvantageous that the strain relief effect decreases with increasing diameter of the wires.

The German patent specification 24 56 977 and 26 37 378 disclose also separate retaining and strain relief means consisting of metal.

The German patent specification 24 46 670 discloses an electrical connector terminal integrally formed of sheet metal. At the lower side, the terminal has two contact extensions by which it can be inserted in apertures of a circuit board. First bent portions of the terminal form contact edges which penetrate the insulation and contact the conductor if the cable is pressed into the contact terminal from above. Second bent portions form a slot, the width thereof increasing toward the lower area so that the cable is secured against an outward movement from the slot. Further, the edges of the slot form indentations in the insulation so that a strain relief is contemporarily achieved.

The known contact terminals are not suited for example in connection with telecommunication connectors structured as modules. A further disadvantage is that with larger diameter wires the danger is encountered that the edges of the slot dig into the insulation up to the conductor so that the conductor undesiredly is engaged. The cutting through the insulation also reduces or eliminates the strain relief. With the known contact terminal, the strain relief decreases with increasing wire diameter. Finally, the known terminal can be used only for a small diameter range.

The present invention provides a connector for insulated conductors, particularly for electrical telecommunication wherein the retaining means for the conductor is simply combined with a strain relief.

SUMMARY OF THE INVENTION

The invention includes an integrally molded basic body of plastic material having one or a plurality of passageways adapted to receive insulated conductors. In the connector according to the invention, flexible tongues are formed at opposing walls. The tongues, extend in a plane approximately perpendicular to the longitudinal axis of the passageway. At the free ends of the tongues, a relatively narrow slot is formed, the most narrow portion of the slot being adjacent the open upper side of the passageway and it has a width smaller than the diameter of the smallest cable to be placed in the connector. The lower portion of the slot having a larger width so that by this, a movement of the cable out of the passageway is resisted. It is further essential to the invention that the tongues are shaped or are connected to the walls of the passageway such that the tongues are uni-directionally resiliently deformed toward one end of the passageway and toward the contacting element within the passageway. In other words, the ends of the tongues face toward the free end of the cable or opposite to the extraction direction so that an effective strain relief is achieved.

With the known connectors it may occur that the cables move out of the passageway as soon as the cover on the passageway is opened. This danger increases with increasing diameter of the cable. With the connector according to the invention, however, the strain relief increases with increasing diameter, the flexibility of the tongues being adapted to retain cables within a large diameter range. Depending on the elasticity and the strength of the insulating material, the tongues mold into the insulating material more or less whereby the cable is effectively secured against displacement out of the connector. The deformation of the tongues and the embedding into the insulation are such that a cutting into the insulation and thus an elimination of the strain relief is avoided.

As already mentioned, it has to be assured that the tongues are deformed in a predetermined manner when the cable is pressed into the slot. In this connection, an embodiment of the invention provides that deflecting surfaces are formed on the tongues adjacent the slot which cause the tongues to be deformed resiliently by a cable such that the ends of the tongues face toward the cable end within the passageway. Different modifications for the deflecting surfaces can be used. According to an embodiment of the invention, the deflecting surfaces can be defined by chamfers formed at the side of the tongues oppositely located of the cable end. The chamfers form oblique surfaces which converge toward the cable end. They assure that both tongues are deflected toward the cable end.

According to a further embodiment of the invention, the width of the slot between the tongues continuously increases toward the bottom of the passageway. According to a further embodiment of the invention, the edges of the slot can include saw-tooth-like projections by which a movement of the cable out of the slot is effectively restricted.

If possible, the tongues should be deflected in total upon an insertion of the cable into the slot. An embodiment of the invention provides that the wall of the tongues facing away from the cable end merge into the wall of the passageway through a radius while the opposite wall of the tongues have a relieving flute adjacent the wall of the passageway. By such a hinging of the tongues to the passageway walls, the tongues can be relatively simply and uni-directionally deflected toward the cable end a the cable is pressed into the slot.

The entrance portion of the slot is funnel-like enlarged in an upward direction in order to facilitate the insertion of the cable.

BRIEF DESCRIPTION OF THE DRAWINGS

The invention is explained in more detail with reference to the accompanying drawings.

DETAILED DESCRIPTION OF THE DRAWINGS

Figure 1:
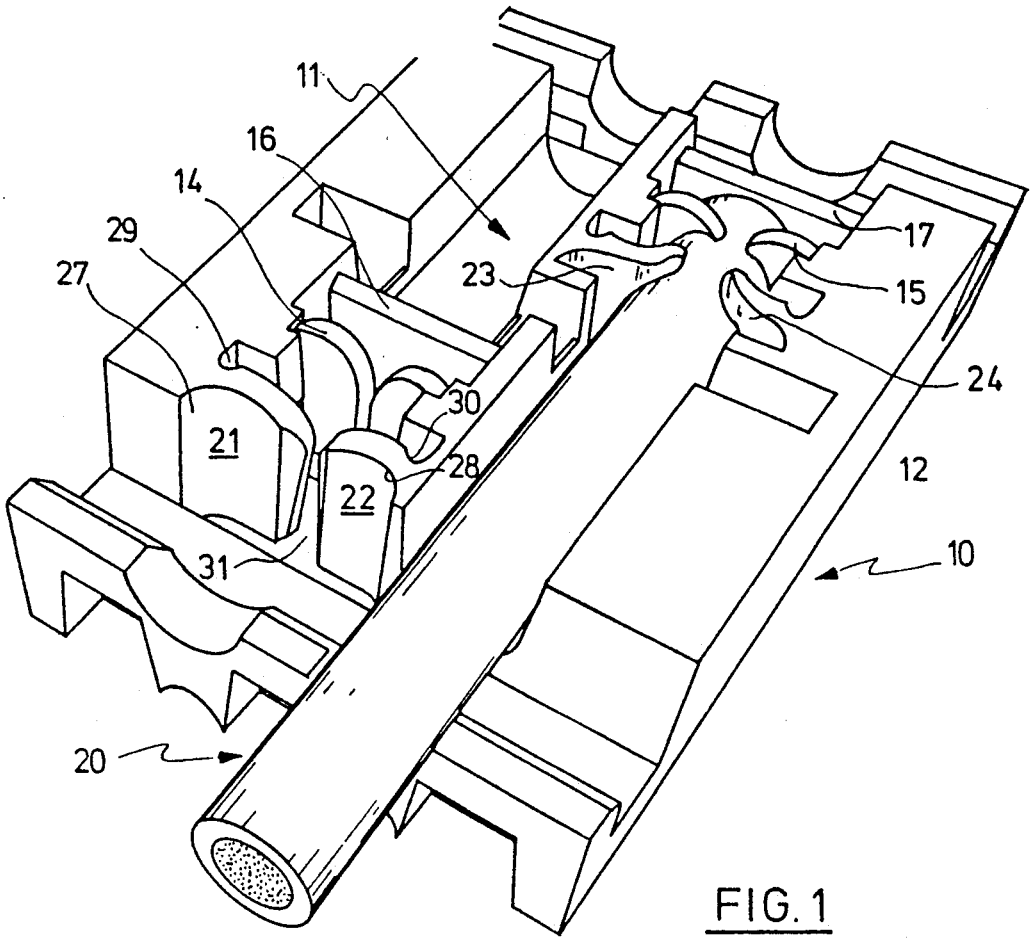
FIG. 1 is a perspective view of a connector according to the invention.

FIG. 1 shows a basic body 10 of a connector for electrical telecommunication cables. The basic body 10 is integrally molded of plastic material and shaped as a module. It includes two transverse passageways 11, 12 extending parallel at a distance from each other throughout the width of the basic body 10. It is understood that the basic body 10 could have a greater length for the receipt of a plurality of cables. Furthermore, it can be combined with a cover which closes the passageways 11, 12 from above. Further, a plurality of such basic bodies 10 could be stacked with each upper basic body defining a cover for the lower one. Connectors of the kind described are generally known.

Know U-shaped contact elements 14 and 15 and knives 16 and 17 of metal are positioned in the passageways 11 and 12. An insulated conductor or cable 20 is introduced in the right passageway 12 from above with its front end being cut off by knife 17 while the contact element 15 cuts into the insulation cable 20 contacting the conductor of cable 20 in a manner known per se to establish an electrical contact.

Figure 2:
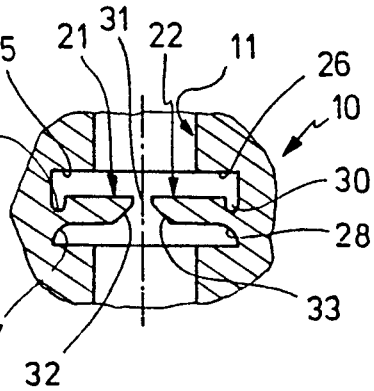
FIG. 2 is a fragmentary plan view, partly in horizontal section, of the retaining members of the connector of FIG. 1.

Tongues 21, 22 and 23, 24, respectively, are formed at the walls of the passageways 11, 12 in front of the contact elements 14, 15. As can be particularly seen in FIGS. 1 and 2, passageways 11, 12, respectively, have recesses 25, 26 which are formed in the area of the tongues 21, 22 and 23, 24, respectively, whereby the joints of the tongues have a larger distance from each other so that they have a relatively large length. In the following, only tongues 21, 22 are described since the tongues 23, 24 are identically formed.

Figure 4:
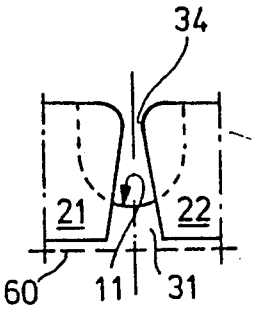
FIG. 4 is a front view of the illustration of FIG. 2 in the direction of arrow 4.

The tongues, 21, 22 merge into the passageway wall through a radius 27, 28 or radiused surface at the side facing away from the contact element 14. A flute 29, 30 is formed in the tongues 21, 22 adjacent the wall of the passageway on the side facing the contact element 14, whereby the thickness of the tongues 21,22 is reduced. A slot 31 is formed between the free ends of tongues 21, 22 which continuously enlarges from the top to the bottom as can be seen in FIG. 4. The most narrow width of the slot 31 is such that it is smaller than the diameter of the smallest cable to be inserted in passageway 11. Oblique surfaces or chamfers 32, 33 are formed on the side of the tongues 21, 22 facing away from the contact element 14. The chambers 32, 33 are reduced in width toward the bottom of the passageway as can be seen in FIG. 1. As can be particularly seen in FIG. 4, the entrance portion of slot 31 is funnel-like, enlarged in its upward direction as shown at 34.

Figure 3:
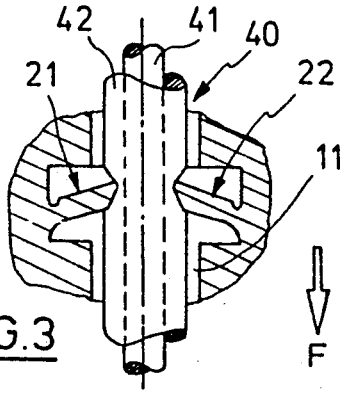
FIG. 3 is a similar illustration as FIG. 2 including a pressed-in cable as can be seen also in the right hand illustration of FIG. 1.

In FIG. 3 a cable 40 can be seen including a conductor wire 41 and an insulation 42 which is pressed into passageway 11. The chamfers 32, 33 on the tongues 21, 22 cause the tongues to be deformed toward one end of the passageway 11 upon insertion of the cable 40 from above the passageway and the free end of the tongues 21, 22 being engaged by the insulation cause the insulation to be deformed and indentations are formed in the insulation by which a retraction of cable 40 in direction of arrow F is restricted. A force on the cable 20 in the direction of the arrow F causes the tongues to bite deeper into the cable insulation. The cable 20 within passageway 12 deforms the tongues 23, 24 in a corresponding manner. It can be seen in FIG. 3 that the tongues 21, 22 are deflected in total by their hinging to the walls of the passageway toward the contact element. It is understood that by a corresponding shape of the tongues 21, 22 or by a corresponding hardness of the insulation 42, the tongues themselves could be deformed or bent in order to achieve a strain relief. It can be recognized moreover that the strain relief increases with increasing diameter of cable 40. The cable 40 is retained within the passageway in that the slot 30 narrows upwardly whereby movement of the cable upward out of the slot is also resisted.

Figure 5:
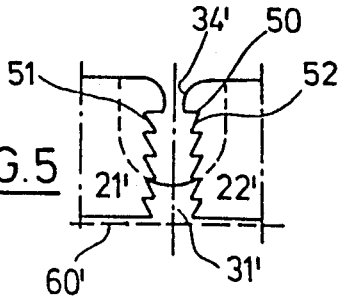
FIG. 5 is a similar view as FIG. 4 showing a modification.

FIG. 5 shows a modification of tongues 21, 22. The tongues 21', 22' of FIG. 5 are molded to the walls of the passageway like tongues 21, 22. They form a slot 31' at the free ends thereof which stepwisely enlarges at 50 below on a continuously constricting entrance portion 34. Saw-tooth-like edges 51, 52, respectively, join to step 50 which form an effective resistance against movement of the cable out of the slot.

As can be seen in FIGS. 4 and 5, the tongues 20, 21 and 21', 22', respectively, are free to move relative to the bottom of recesses 25,26 of the passageway 11,12, the bottom being indicated at 60 and 60', respectively.

We claim:

1. A connector for an electrical cable, particularly for electrical telecommunication, comprising a housing of plastic material including a basic body having at least one transverse passageway which passageway has an axis, a contacting element disposed in said passageway and flexible retaining elements integrally formed with said basic body and being positioned in said passageway, said retaining elements being resiliently deformed when said cable is introduced into said passageway to retain said cable against outward movement, said flexible retaining elements comprising tongues formed on opposite walls of said passageway in a plane approximately perpendicular to said axis of said passageway, the free opposing ends of said tongues forming a narrow generally sphenoidal slot having a first entrance portion, which is funnel-like and enlarged in the direction toward the open side of the passageway, leading to the most narrow portion of said slot having a width smaller than the diameter of the smallest cable to be placed in the connector, said slot continuously enlarges toward the bottom of the passageway such that the portion of said slot adjacent the bottom of said passageway has a larger width than the most narrow portion of said slot, and said tongues being joined to the walls of said passageway by means for affording deflection of said tongues such that said tongues are resiliently deformed toward one end of said passageway and toward the contacting element within said passageway when a wire is inserted into said passageway.

2. The connector according to claim 1, wherein saw-tooth-like projections are formed on the ends of the tongues defining the edges of said slot.

3. The connector according to claim 1, wherein the tongues are at least partially free to move relative to the bottom of said passageway.

4. The connector according to claim 1, wherein deflecting surfaces are formed on said tongues adjacent said slot.

5. The connector according to claim 4, wherein said deflecting surfaces are defined by chamfers which are formed at the sides of said tongues facing away from said contacting element.

6. The connector according to claim 4, wherein said tongues merge into the walls of said passageway through a radius on the side facing away from said contacting element while a relieving flute is formed into the tongues adjacent said walls of the passageway on the side of said tongues facing said contacting element.

7. A connector for an electrical cable, particularly for electrical telecommunication, comprising a housing of plastic material including a basic body having at least one transverse passageway which passageway has an axis, a contacting element disposed in said passageway and flexible retaining elements integrally formed with said basic body and being positioned in said passageway, said retaining elements being resiliently deformed when said cable is introduced into said passageway to retain said cable against outward movement, said flexible retaining elements comprising tongues formed on opposite walls of said passageway in a plane approximately perpendicular to said axis of said passageway, the free opposing ends of said tongues forming a narrow generally sphenoidal slot having a first entrance portion leading to the most narrow portion of said slot adjacent the open upper side of the passageway and having a width smaller than the diameter of the smallest cable to be placed in the connector, the portion of said slot adjacent the bottom of said passageway having a larger width than the upper portion of said slot, and said tongues merge into the passageway wall through a radius on the side facing away from said contacting element while a relieving flute is formed into the tongue adjacent said passageway wall on the side of said tongues facing said contacting element for affording deflection of said tongues such that said tongues are resiliently deformed toward one end of said passageway and toward the contacting element within said passageway when a wire is inserted into said passageway.

8. A connector for an electrical cable, particularly for electrical telecommunication, comprising a housing of plastic material including a basic body having at least one transverse passageway which passageway has an axis, a contacting element disposed in said passageway and flexible retaining elements integrally formed with said basic body and being positioned in said passageway, said retaining elements being resiliently deformed when said cable is introduced into said passageway to retain said cable against outward movement, said flexible retaining elements comprising tongues formed on opposite walls of said passageway in a plane approximately perpendicular to said axis of said passageway, the free opposing ends of said tongues forming a narrow generally sphenoidal slot having a first entrance portion which is funnel-like and enlarged in the direction toward the open side of the passageway and which narrows toward the most narrow portion of said slot adjacent the open upper side of the passageway and said slot having a width smaller than the diameter of the smallest cable to be placed in the connector, the portion of said slot adjacent the bottom of said passageway having a larger width than the upper portion of said slot, and said tongues being joined to the walls of said passageway by means for affording deflection of said tongues such that said tongues are resiliently deformed toward one end of said passageway and toward the contacting element within said passageway and said tongues are formed with deflecting surfaces adjacent said slot for affording deflection of said tongues when a wire is inserted into said passageway.

9. The connector according to claim 8 wherein the tongues are free from the passageway walls at the bottom of the slot to allow the tongues to be deflected throughout the length of the slot.

10. The connector according to claim 8, wherein said tongues merge into the passageway wall through a radius on the side facing away from said contacting element while a relieving flute is formed into the tongue adjacent said passageway wall on the side of said tongues facing said contacting element.

* * * * *